United States Patent [19]

Axelrod et al.

[11] Patent Number: 5,032,145

[45] Date of Patent: Jul. 16, 1991

[54] LOW TEMPERATURE FLUIDITY IMPROVER AND COMPOSITIONS THEREOF

[75] Inventors: Joan C. Axelrod, Media, Pa.; Sheldon Chibnik, Cherry Hill; David J. Baillargeon, Cranbury, both of N.J.

[73] Assignee: Mobil Oil Corporation, Fairfax, Va.

[21] Appl. No.: 287,369

[22] Filed: Dec. 20, 1988

Related U.S. Application Data

[63] Continuation of Ser. No. 40,503, Apr. 20, 1987, abandoned.

[51] Int. Cl.[5] ..... C10L 1/18; C10L 1/22

[52] U.S. Cl. ..... 44/386; 44/391; 560/196

[58] Field of Search ..... 44/72, 63, 74, 71, 75, 44/386, 391; 560/196

[56] References Cited

U.S. PATENT DOCUMENTS

| | | | |
|---|---|---|---|
| 2,426,206 | 8/1947 | Hamilton et al. | 260/566 |
| 3,117,931 | 1/1964 | Westlund et al. | 252/51.5 |
| 3,962,104 | 6/1976 | Swietlik et al. | 252/32 |
| 3,991,098 | 11/1976 | Okamoto | 560/196 |
| 4,048,081 | 9/1977 | Machleder et al. | 252/51.5 R |
| 4,049,564 | 9/1977 | Ryer et al. | 252/51.5 A |
| 4,108,613 | 8/1978 | Frost | 44/62 |
| 4,129,508 | 12/1978 | Friihauf | 252/33 |
| 4,185,485 | 1/1980 | Schick et al. | 560/196 |
| 4,491,455 | 1/1985 | Ishizaki et al. | 44/62 |
| 4,575,382 | 3/1986 | Sweeney et al. | 44/57 |
| 4,631,071 | 12/1986 | Axelrod et al. | 44/71 |
| 4,639,256 | 1/1987 | Axelrod et al. | 44/71 |
| 4,657,562 | 4/1987 | Axelrod et al. | 44/71 |
| 4,675,027 | 6/1987 | Chibnik | 44/57 |
| 4,883,495 | 11/1989 | Jaeckel et al. | 560/196 |

*Primary Examiner*—Prince E. Willis, Jr.
*Assistant Examiner*—Ellen M. McAvoy
*Attorney, Agent, or Firm*—Alexander J. McKillop; Charles J. Speciale; Howard M. Flournoy

[57] ABSTRACT

Cloud point, pour point and filterability of diesel and heating fuels are improved by the incorporation of minor amounts of an additive prepared from the reaction products of a long chain oligomeric alkylsuccinic anhydride, a higher alkyl linear saturated alcohol and a tertiary amino substituted polyol.

26 Claims, No Drawings

LOW TEMPERATURE FLUIDITY IMPROVER AND COMPOSITIONS THEREOF

This application is a continuation of Ser. No. 040,503, filed on Apr. 20, 1987, and now abandoned.

BACKGROUND OF THE INVENTION

This invention relates to fuel compositions having improved low temperature characteristics. More particularly, this invention relates to compositions comprising distillate hydrocarbon fuels having minor amounts sufficient to improve cloud point, pour point and filterability of diesel and heating fuels of an additive prepared from the reaction products of a long chain oligomeric alkylsuccinic anhydride, a higher alkyl linear saturated alcohol and a tertiary amino substituted polyol.

As is well known to those skilled in the art, diesel fuels and the like present problems at low temperatures because of poor flow characteristics and clogging of fuel filters. Consequently, there is a continuing need for more efficient means for solving these low temperature problems. The materials described herein, when added to such fuels, improve their low temperature filterability and flowability characteristics.

Although many lubricant and fuel additives have been described from various alkylsuccinic anhydrides and their esters, applicants have discovered that effective products for improving low temperature properties of diesel fuels and the like can be made from specific combinations of raw materials within a limited molecular weight range comprising an alkylsuccinic anhydride, an aliphatic alcohol and a polyhydroxy tertiary amine.

U.S. Pat. No. 4,108,613 teaches the use of a mixture of (1) the reaction product and an epoxidized alpha-olefin with a nitrogen-containing compound selected from ammonia, an amine, a polyamine or a hydroxyamine and (2) an ethylene-olefin copolymer as an additive to depress the pour point of hydrocarbonaceous fuels and oils.

U.S. Pat. No. 3,962,104 discloses lubricating oil compositions containing minor amounts of quaternary ammonium salts useful as oil improving additives wherein the quaternary ammonium salts utilize a cation derived from the reaction product of a tertiary amine with an olefin oxide and water. None of these prior art materials, however, use the specific combination of raw materials disclosed herein.

Unlike prior art such as U.S. Pat. No. 3,117,937, the esters of this invention contain acyl groups derived from complex acids which are the mixed ester-carboxylic acid reaction products from an alkylated succinic anhydride and a monoalcohol. The initial reactant for introducing the acyl fragment is an anhydride. These acyl groups contain a minimum of 44 carbon atoms (at least 28 from the anhydride fragment, and at least 16 from the monoalcohol fragment), and when used at the appropriate levels in distillate fuels, impart unique improvements in the cloud point and the filterability temperature of the resulting fuel compositions.

One object of this invention is to provide an additive product which will operate to lower the cloud point and the pour point of hydrocarbon fuels and improve their filterability.

A further object of this invention is to provide a facile process for preparing these additive products.

SUMMARY OF THE INVENTION

Applicants have now discovered novel fuel additive products useful in improving the low temperature characteristics of distillate fuel compositions, which compositions comprise a major proportion of a liquid hydrocarbon fuel and a minor proportion sufficient to impart improved filterability characteristics thereto and to provide lower pour point and lower cloud point to said composition comprising the reaction product of (1) a substantially linear alkylsuccinic anhydride prepared from a substantially linear oligomerized olefin of the following generalized structure:

$$(RCH{=}CH_2)_n$$

where n is 2–4, and where R is about $C_2$ to $C_{32}$ hydrocarbyl; (2) a substantially linear saturated monoalcohol having at least 16 carbon atoms (preferably about $C_{16}$ to $C_{32}$) and (3) an amino alcohol having at least one tertiary amino group and at least two hydroxyl groups and to methods of using same. Hydrocarbyl includes alkyl, alkenyl, aralkyl, alkaryl and cycloalkyl, etc.

DESCRIPTION OF PREFERRED EMBODIMENTS

Applicants have found that to be effective the products for improving low temperature properties of diesel fuels in accordance with their discovery must be made from specific combinations of raw materials within a limited molecular weight range:

(1) The alkylating olefin used to prepare the alkylsuccinic anhydride must be essentially linear.

(2) The olefin must be carefully oligomerized so that for $(RCH{=}CH_2)_n$, n is about 2–4. When n is 1 or 5 or more, the materials have proven ineffective. (Mixtures, however, may contain some material where n is outside the limits).

(3) The monoalcohol must be essentially linear, saturated, and longer than about $C_{16}$.

(4) The amino alcohol must be present; normal diesters of alkylsuccinic anhydrides are ineffective. The requirements are (a) at least one tertiary amino group and (b) more than one hydroxyl group.

(5) Reactant molar ratios are chosen such that the monofunctional alcohol, the alkylated difunctional anhydride, and the polyfunctional aminoalcohol are nominally in the range of 1:1:1/x to 1:1:1, where x equals the number of reactive alcohol groups on the aminoalcohol component.

Suitable liquid hydrocarbon fuels or distillates generally have an initial boiling point of about 350° F. and an end point of about 675° F. However, it is understood that the additives in accordance with this invention may be utilized in hydrocarbon fuels outside these specific boiling ranges. Generally speaking, these additive products may be utilized in any unmodified diesel fuel which has poor flow characteristics at winter temperatures and where wax crystal formation occurs.

Suitable alkyl succinic anhydrides are those wherein the alkyl group is an oligomer of long chain alkenes. As noted hereinabove, the chain must contain at least 14 carbon atoms. There is no critical upper limit. However, preferably, the chain should contain from 16 to about 40 carbon atoms. With respect to the olefin described above as being $(RCH{=}CH_2)_2$, the nature of the R substituent is not critical but preferably may contain from about 6 to about 24 carbon atoms. Suitable monoalcohols are those as stated above, linear saturated and longer than $C_{16}$. They may contain up to about 40 carbon atoms and preferably from 16 to about 24 carbon atoms. The critical aspect of the amino alcohol is that it must contain at least one tertiary amino group and more than one hydroxy group, that is, at least two hydroxy groups. Suitable amino alcohols include the following:

N,N,N',N' Tetrakis (2-hydroxyethyl) ethylenediamine

N,N,N',N' Tetrakis (2-hydroxypropyl) ethylenediamine

N-methyl diethanolamine

N,N,N' tris(2-hydroxypropyl)-n-tallowalkyl-1,3-diaminopropane

N,N,-bis(2-hydroxyethyl)-n-tallowamine

The reactant molar ratios of the monoalcohol, the alyl succinic anhydride, and the aminoalcohol are consistent with a two-step reaction sequence used in the preparation of the additives of this invention. In the first step, the monoalcohol and the difunctional anhydride react nominally in a 1:1 molar ratio to give an intermediate ester-carboxylic acid. This intermediate is then reacted with the polyfunctional aminoalcohol under such conditions that at least one, and preferably all, the available alcohol groups in the aminoalcohol are consumed via esterification with the carboxylic acid. Thus, the intermediate ester-carboxylic acid and the aminoalcohol react in a molar ratio between 1:1 and 1:1/x, where x equals the number of available alcohol groups in the amino alcohol component. This two-step reaction sequence, therefore, provides a method for using the difunctional anhydride to link a monoalcohol and a polyfunctional aminoalcohol together.

Any reaction conditions (temperatures, pressures and the like) which are suitable maybe used in this two-step procedure to obtain the final reaction products.

The additives in accordance with the invention may be used effectively in hydrocarbyl distillate diesel fuels in an amount ranging from about 0.01 wt. % to about 5 wt. % or more based on the total weight of the fuel composition. In certain cases depending, for example, on a particular fuel and/or on weather conditions, up to about 10 wt. % may be used.

Other known additives may also be used for their intended purposes without deleterious effect upon the additives of the invention.

The following exemplary material is intended to be merely illustrative of the invention. It is not intended in any way to limit it.

EXAMPLE 1

Preparation of an Oligomer

A commercial mixture of hexadecenes and octadecenes in which the double bond may be placed anywhere in the linear carbon chain (500 g) was mixed with a 2.3 g n-butanol and heated to 52°-57° C. in a dry inert atmosphere. Born trifluoride (7.3 g) was gradually added over a three hour period, maintaining the temperature in about this range to accelerate the reaction without corrosion of the equipment. The reaction mixture was held at this temperature for a further three hours after the addition was complete. The catalyst was neutralized with 30 cc of concentrated ammonia in 200 cc water, the product was washed with water until neutral and stripped at 150° C. under vacuum. Analysis by gas chromatography indicated that monomeric alkenes were essentially completely removed and bromine number analysis showed that the product was essentially a dimer.

EXAMPLE 2

Preparation of Alkylsuccinic Anhydride

The oligomer prepared in Example 1 (155.5 g) was heated to 235° C. and 41.5 g maleic anhydride was added over a two hour period. The mixture was held at that temperature an additional three hours before stripping the excess maleic anhydride at 160° C. under vacuum for three hours.

EXAMPLE 3

Preparation of Additives

Behenyl alcohol (22.6 g, 0.07 moles) and the product of Example 2 (83.5 g, 0.07 moles) were heated at 130° C. for two hours to form the monoester of the anhydride. Quadrol (commercial N,N,N',N' tetrakis (2-hydroxypropyl) ethylenediamine, 5.1 g, 0.018 moles) was added and the reaction mixture was esterified at 190° C. with azeotropic removal of water. The product was stripped of solvent at 175° C. for one hour under vacuum.

The materials are blended (0.1% by weight) into a typical diesel fuel and tested for cloud point and filterability by the LTFT procedure described below. Results are shown in Table 1 where the remarks column indicates limitations and differences from other esters. Oligomers with a degree of polymerization <5 were prepared under different conditions (catalyst, temperature) from Example 1, but the method of polymerization is not unique.

| Typical Diesel Fuel | Distillation | °F. |
|---|---|---|
| | Initial | 366 |
| | 50° C. | 487 |
| | End | 663 |
| API Gravity | 34.8 | |
| Sulfur | 0.17% | |
| Aniline Point | 130° F | |

CFPP, Cold Filter Plugging Point (IP 309/76: Institute of Petroleum Test 309/76). LTFT, Low Temperature Flow Test for Diesel Fuels, a filtration test under consideration by CRC (Coordination Research Council). LTFT Procedure: The test sample (200 ml) is gradually lowered to the desired testing temperature at a controlled cooling rate. After reaching that temperature the sample is removed from its cold box and filtered under vacuum through a 17 micrometer screen. If the entire sample can be filtered in less than 60 seconds it shall be considered as having passed the test.

A review of Table I highlights the criticality claimed for the individual reactants. Note particularly the examples where the degree of polymerization in which m is greater than 5, or 1, CP is zero except in 1 instance. Thus the data of Table I show the highly successful and/or improved results obtained when additives in accordance with the invention are incorporated into diesel fuels.

TABLE 1

| Item | Olefin[4] | | | | | | Amino | |
|---|---|---|---|---|---|---|---|---|
| No. | Length | Type[1] | DP[2] | Monoalcohol | CP[3] | LTFT[4] | Alcohol | Remarks |
| 1 | $C_{16-18}$ | I | 2 | $C_{22}$ | 7 | 4 | Quadrol | |

TABLE 1-continued

| Item No. | Olefin[4] Length | Type[1] | DP[2] | Monoalcohol | CP[3] | LTFT[4] | Amino Alcohol | Remarks |
|---|---|---|---|---|---|---|---|---|
| 2 | $C_{16-18}$ | I | 2 | $C_{16}$ | 0 | | " | |
| 3 | $C_{18-24+}$ | A | 2 | $C_{18}$ | 4 | 4 | " | |
| 4 | " | " | " | Isostearyl | 1 | | " | Branched alcohol |
| 5 | " | " | " | $C_{16-18}$ Unsaturated | 1 | | " | Unsaturated alcohol |
| 6 | " | " | " | Oleyl | 1 | | " | Unsaturated alcohol |
| 7 | " | " | " | $C_{20}$ | 7 | 6 | " | |
| 8 | " | " | " | $C_{22}$ | 6 | 4 | " | |
| 9 | " | " | " | $C_{20-34+}$ | 6 | 4 | " | |
| 10 | " | " | " | Phenylstearyl (See Remarks) | 1 | | " | Branched alcohol |
| 11 | " | " | " | Phenylstearyl (See Remarks) | 1 | | " | Polyethoxylated $C_{6-10}$ alcohol |
| 12 | $C_{16-18}$ | A | 5 | $C_{14}$ | 0 | | " | High DP, Short chain alcohol |
| 13 | $C_{18-24+}$ | A | 1 | $C_{14}$ | 1 | | " | Not oligomer |
| 14 | $C_{16-18}$ | I | 1 | $C_{14}$, $C_1$ | 0 | | None | Ordinary diester, methanol + $C_{14}OH$ |
| 15 | $C_{16-18}$ | A | 5 | $C_1$ | 0 | | Quadrol | High DP, Short chain alcohol |
| 16 | $C_{18-24+}$ | A | 1 | $C_{14}$, $C_1$ | 0 | | None | Ordinary diester |
| 17 | $C_{16-18}$ | I | 1 | $C_{14}$ | 0 | | Quadrol | Not oligomer |
| 18 | $C_{16-18}$ | I | 5 | $C_{18}$ | 0 | | " | High DP |

[1]I = Internal, A = Alpha Olefin
[2]DP = Degree of Polymerization, n in $(RCH{=}CH_2)_n$
[3]Degrees Lowering of Cloud Point (F.)
[4]Degrees Lowering in Filterability Test (F.)
[4]Olefin used in preparation of alkylsuccinic anhydrides

What is claimed is:

1. A composition comprising a major proportion of a liquid hydrocarbon fuel and a minor proportion of an additive product sufficient to impart improved filterability characteristics thereto and to provide a lower pour point and a lower cloud point for said composition, said additive product is prepared by reacting (1) a substantially linear alylsuccinic anhydride having been prepared from a substantially linear oligomerized olefin of the following generalized structure:

$$(RCH{=}CH_2)n$$

where n is 2–4 and where R is from about $C_{14}$ to about $C_{32}$ hydrocarbyl; and (2) a substantially linear saturated monoalcohol having at least 16 carbon atoms, where (1) and (2) are reacted under conditions sufficient to give an intermediate ester-carboxylic acid and reacting under esterification conditions said ester-carboxylic acid; and (3) an amino alcohol having at least one tertiary amino group and at least two hydroxyl groups wherein the molar ratio of succinic anhydride to monoalcohol to aminoalcohol ranging from about 1:1:1 to 1:1:1/x where x equals the number of available alcohol groups in the aminoalcohol.

2. The composition of claim 1 wherein said alkylsuccinic anhydride is prepared from a mixture of hexadecene and octadecenes oligomerized olefins and maleic anhydride and where n is 2; the monoalcohol is behenyl alcohol and the amino alcohol is N,N,N', N'-tetrakis (2-hydroxypropyl) ethylenediamine.

3. The composition of claim 2 wherein said alkylsuccinic anhydride is prepared from a mixture of essentially linear $C_{16}$–$C_{18}$ olefins and the monoalcohol is a saturated $C_{18}$ alcohol.

4. The composition of claim 3 wherein the monoalcohol is a $C_{20}$ saturated alcohol.

5. The composition of claim 3 wherein said olefin is a $C_{16}$ olefin.

6. The composition of claim 3 wherein said olefin is a $C_{18}$ olefin.

7. The composition of claim 1 wherein said olefin is a mixture of $C_{18}$ to about $C_{32}$ olefins.

8. The composition of claim 2 wherein said olefin is a mixture of $C_{18}$ to about $C_{32}$ olefins.

9. The composition of claim 1 wherein the fuel is a distillate fuel.

10. The composition of claim 9 wherein said fuel is a diesel fuel.

11. An additive product suitable for use in liquid hydrocarbon fuels imparting thereto improved filterability characteristics and providing lower pour points and lower cloud points for said fuels, said additive product is prepared by reacting (1) a substantially linear alkylsuccinic anhydride having been prepared from a substantially linear oligomerized olefin of the following generalized structure:

$$(RCH{=}CH_2)n$$

where n is 2–4 and where R is from about $C_{14}$ to about $C_{32}$ hydrocarbyl; and (2) a substantially linear saturated monoalcohol having at least 16 carbon atoms; and where (1) and (2) are reacted under conditions sufficient to give an intermediate ester-carboxylic acid and reacting under esterification conditions said ester-carboxylic acid and (3) an amino alcohol having at least one tertiary amino group and at least two hydroxyl groups wherein the molar ratio of succinic anhydride to monoalcohol to amino alcohol ranging from about 1:1:1 to 1:1:1/x where x equals the number of available alcohol groups in the amino alcohol.

12. The additive product of claim 11 wherein said alylsuccinic anhydride is prepared from a mixture of hexadecene and octadecenes oligomerized olefins and maleic anhydride and where n is 2; the monoalcohol is behenyl alcohol and the amino alcohol is N,N,N', N'-tetrakis (2-hydroxypropyl) ethylenediamine.

13. The additive product of claim 12 wherein said alkylsuccinic anhydride is prepared from a mixture of essentially linear $C_{18}$–$C_{32}$ olefins and the monoalcohol is a saturated $C_{18}$ alcohol.

14. The additive product of claim 13 wherein the monoalcohol is a $C_{20}$ saturated alcohol.

15. The additive product of claim 10 wherein the olefin is a $C_{16}$ olefin.

16. The additive product of claim 11 wherein the olefin is a $C_{18}$ olefin.

17. The additive product of claim 11 wherein the fuel is a distillate fuel.

18. The additive product of claim 17 wherein said fuel is a diesel fuel.

19. The additive product of claim 11 wherein said olefin is a mixture of $C_{18}$ to about $C_{32}$ olefins.

20. A process of making a hydrocarbyl fuel additive product suitable for use in liquid hydrocarbon fuels imparting thereto improved filterability characteristic and providing lower pour points and lower cloud points for said fuels, said additive product is prepared by reacting (1) a substantially linear alkylsuccinic anhydride having been prepared from a substantially linear oligomerized olefin of the following generalized structure:

$$(RCH{=}CH_2)n$$

where n is 2–4 and where R is from about $C_{14}$ to about $C_{32}$ hydrocarbyl; and (2) a substantially linear saturated monoalcohol having at least 16 carbon atoms; and where (1) and (2) are reacted under conditions sufficient to give an intermediate ester-carboxylic acid and reacting under esterification conditions said ester-carboxylic acid and (3) an aminoalcohol having at least one tertiary amino group and at least two hydroxyl groups wherein the molar ratio of succinic anhydride to monoalcohol to aminoalcohol ranging from about 1:1:1 to 1:1:1/x where x equals the number of available alcohol groups in the amino alcohol.

21. The process of claim 20 wherein said olefin is a mixture of $C_{18}$ to about $C_{32}$ olefins.

22. The process of claim 20 wherein said alkylsuccinic anhydride is prepared from a mixture of hexadecene and octadecenes oligomerized olefins and maleic anhydride and where n is 2; the monoalcohol is behenyl alcohol and the amino alcohol is N,N,N', N'-tetrakis (2-hydroxypropyl) ethylenediamine.

23. The process of claim 20 wherein said alkylsuccinic anhydride is prepared from a mixture of essentially linear $C_{16}$–$C_{18}$ olefins and the monoalcohol is a saturated $C_{18}$ alcohol.

24. The process of claim 20 wherein the monoalcohol is a $C_{20}$ saturated alcohol.

25. The process of claim 21 wherein said olefin is a $C_{16}$ olefin.

26. The process of claim 21 wherein said olefin is a $C_{18}$ olefin.

* * * * *